US005678972A

United States Patent [19]

Böckler et al.

[11] Patent Number: 5,678,972

[45] Date of Patent: Oct. 21, 1997

[54] FACILITY FOR THE SPACE-SAVING PARKING OF MOTOR VEHICLES

[75] Inventors: Hans Böckler, Hannover; Dieter Schütt, München, both of Germany

[73] Assignee: Siemens Aktiengesellschaft, Munich, Germany

[21] Appl. No.: 387,901

[22] PCT Filed: May 10, 1993

[86] PCT No.: PCT/DE93/00406

§ 371 Date: Feb. 17, 1995

§ 102(e) Date: Feb. 17, 1995

[87] PCT Pub. No.: WO94/04779

PCT Pub. Date: Mar. 3, 1994

[30] Foreign Application Priority Data

Aug. 20, 1992 [DE] Germany ..... 42 27 609.8

[51] Int. Cl.[6] ..... B65G 1/04

[52] U.S. Cl. ..... 414/239; 414/261; 414/286; 414/240; 414/234

[58] Field of Search ..... 414/227, 231, 414/233, 234, 236, 232, 239, 240, 241, 242, 243, 244, 245, 246, 249, 252, 253, 254, 255, 259, 260, 283, 261, 262, 264, 286, 281, 282, 331; 364/378

[56] References Cited

U.S. PATENT DOCUMENTS

| | | | |
|---|---|---|---|
| 1,874,859 | 8/1932 | Been . | |
| 2,745,561 | 5/1956 | Natkanski . | |
| 2,826,312 | 3/1958 | Francis | 414/240 |
| 2,936,082 | 5/1960 | Alimanestiano . | |
| 3,115,257 | 12/1963 | Kubik | 414/263 X |
| 3,680,718 | 8/1972 | Miyachi | 414/239 |
| 3,746,191 | 7/1973 | Bianca | 414/240 |
| 5,333,983 | 8/1994 | Hatouchi et al. | 414/331 |

FOREIGN PATENT DOCUMENTS

| | | | |
|---|---|---|---|
| 0 143 139 | 6/1985 | European Pat. Off. . | |
| 1 252 821 | 12/1960 | France . | |
| 78 440 | 6/1962 | France . | |
| 356717 | 10/1961 | Switzerland | 414/239 |
| 901965 | 7/1962 | United Kingdom | 414/239 |
| 8 911 013 | 11/1989 | WIPO . | |

*Primary Examiner*—Frank E. Werner
*Attorney, Agent, or Firm*—Hill, Steadman & Simpson

[57] ABSTRACT

The mechanical facility, according to the invention, for the space-saving parking of motor vehicles has at least one entrance and exit EA and a multiplicity of parking spaces EP, and a multiplicity of stacking carriages SW, which are arranged one beside the other and can be displaced to the side, is provided, of which each stacking carriage is formed such that a multiplicity of pairs of pallets PL, located one beside the other and intended for receiving parked motor vehicles, can be arranged thereon one above the other and/or one beneath the other. By lateral displacement of the stacking carriages SW, a lifting passage HGS can be produced between any two selected stacking carriages SW. A lifting carriage HW can travel to the lifting passage, which lifting carriage can remove individual pallets PL from a stacking carriage SW adjacent to the lifting passage HGS, and introduce them into said stacking carriages SW. The lifting carriage HW can lift any pallet PL onto the level of at least one entrance or exit EA.

20 Claims, 21 Drawing Sheets

FACILITY FOR THE SPACE-SAVING PARKING OF MOTOR VEHICLES

BACKGROUND

The invention generally relates to a mechanical facility for the space-saving parking of motor vehicles. More specifically, the present invention relates to a parking facility with stackable parking spaces on moveable carriages. The invention strives to improve such installations in order to be able to realize the same in a more cost-effective and space-saving manner.

A parking facility is described in EP 0 143 139 A2. In the case of that facility, a stacking carriage, which can be displaced to the side, is provided, which stacking carriage is formed such that a multiplicity of pairs of pallets, located one beside the other and intended for receiving parked motor vehicles, can be arranged thereon one above the other and/or one beneath the other. By lateral displacement of the stacking carriage, a lifting passage can be produced, in which a lifting unit can travel up and down, which lifting unit can remove individual pallets from the stacking carriage adjacent to the lifting passage, and introduce them into the stacking carriage, and can lift any pallet onto the level of at least one entrance or exit.

This facility has the disadvantage that one lifting passage is necessary over a width corresponding to the width of two parking spaces located one beside the other. Consequently, the density, in relation to the surface area of the facility, of the available parking spaces, is restricted such that, over a surface area corresponding to two parking spaces located one beside the other and the lifting passage necessary therefor, a maximum of two vehicles can be parked in each storey of the facility.

SUMMARY OF THE INVENTION

An object of the invention is, then, to increase the density of the parking spaces, with the result that it is possible to park vehicles in an even more space-saving manner.

This object is achieved according to the invention by a facility which is intended for the space-saving parking of motor vehicles.

In this arrangement, a multiplicity of stacking carriages, which are arranged horizontally and longitudinally along the facility in an end-to-end fashion and can be displaced longitudinally, is provided, of which each stacking carriage is formed such that a multiplicity of pairs of pallets, located one beside the other and intended for receiving parked motor vehicles, can be arranged thereon one above the other and/or one beneath the other. By lateral displacement of the stacking carriages, a lifting passage can be produced between any two selected stacking carriages, to which lifting passage a lifting apparatus can travel, which lifting apparatus can receive individual pallets from a stacking carriage adjacent to the lifting passage, and introduce them into said stacking carriages. The lifting apparatus can move any pallet vertically through the lifting passage and lift it onto the level of at least one entrance or exit.

The facility according to the invention is suitable for the parking of motor vehicles in an extremely constricted amount of space, e.g. in built-up areas. In this arrangement, each parking position can be reached directly for loading and unloading by displacing the lifting passage.

In an embodiment, a parking facility is provided which has a plurality of stacking carriages arranged end-to-end in a longitudinally horizontal manner. These stacking carriages are longitudinally moveable to form a lifting passage between a selected two of the stacking carriages or at an end of the facility. A plurality of pallets are removably supportable in vertically spaced, stacked parking positions on the stacking carriages, and each pallet is dimensioned to support a conventionally-sized automobile. The facility has an access level to and from which pallets are delivered. For example, this recess level may extend along a top of the stacking carriages and includes an entrance and exit access for automobiles. A means for moving the pallets is provided, including a pair of lifting carriages are longitudinally horizontally moveable along opposite sides of the stacking carriages, the pair of lifting carriages cooperatively engaging and supporting respective opposite sides of a selected one of the pallets and cooperatively conveying that pallet between a position on one of the stacking carriages and the access level via the lifting passage.

Preferably, in an embodiment of the parking facility, the facility is operated so that a width of the lifting passage in a direction between the stacking carriages is approximately the width of an automobile.

In an embodiment, the facility and means for moving further includes a conveying apparatus for horizontally delivering a pallet along the access level to and from a storage of unused pallets and the lifting passage. The conveying apparatus preferably has at least two parallel rails on which the pallets are rollably supportable. At least two parallel chains are disposed parallel to the rails and horizontally spaced from each other and are longitudinally moveable in unison. A rod is securable transversely across the chains and is engageable with a niche in a selected one of the pallets. The engaged rod holds the pallet relative to the chains for movement therewith along the rails supporting the pallet.

Each of the two lifting carriages includes a base which is rollably supported on at least one rail and a vertical member connected to the base. A lifting mechanism is vertically moveable along the vertical member. The lifting mechanism is equipped with means for selectively engaging a respective side of one of the pallets so that the pallet can be selectively lifted or released at a desired position, such as on one of the stacking carriages or at the access level.

The means for selectively engaging preferably includes a pair of arms which are cooperatively pivotable between a disengaged position free of the pallet to an engaged position under the pallet. Other means which liftably engage a side of the pallet are within the scope of the invention.

The lifting carriages may be provided in various configurations including one in which the base is supported on a single lower rail.

Therefore, an advantage of the present invention is to provide a high-density parking facility which efficiently utilizes a restricted space.

Additional features and advantages of the present invention are described in, and will be apparent from, the Detailed Description of the Presently Preferred Embodiments and from the drawings.

The invention is described in more detail hereinbelow with reference to preferred exemplary embodiments and with the aid of the figures.

DETAILED DESCRIPTION OF THE PRESENTLY PREFERRED EMBODIMENTS

Figure 22:
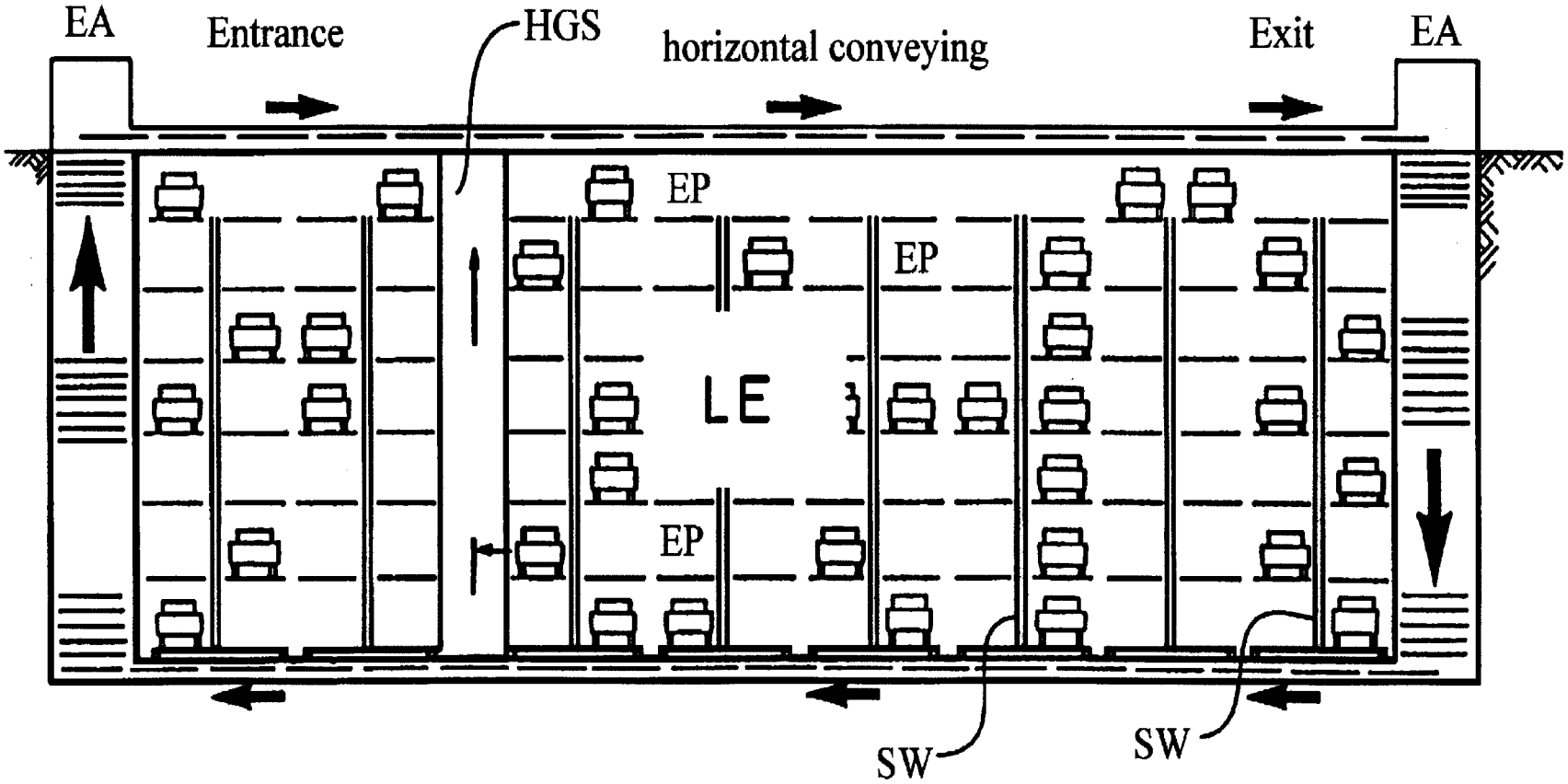
FIG. 22 shows, schematically, the transporting path for the pallets in the form of a closed cycle, using the example of an installation with longitudinal displacement in the region of the storage unit.

A parking facility, according to the invention, for the space-saving parking of motor vehicles is illustrated, for example, in FIGS. 5–8 and 22. The facility as illustrated in FIG. 22 has at least one entrance or exit access EA and a multiplicity of parking spaces EP, and a multiplicity of stacking carriages SW, which are arranged one beside the other and can be displaced from side to side, each stacking carriage is formed such that a multiplicity of pairs of pallets PL (FIG. 1), located one beside the other and intended for receiving parked motor vehicles, can be arranged thereon one above the other and/or one beneath the other. By lateral displacement of the stacking carriages SW, a lifting passage HGS can be produced between any two selected stacking carriages SW. A lifting carriage HW illustrated, for example, in FIGS. 9 and 10, can travel to the lifting passage HGS, which lifting carriage HW can remove individual pallets PL from a stacking carriage SW adjacent to the lifting passage HGS, and introduce them into the stacking carriages SW. The lifting carriage HW can lift any pallet PL onto the level of at least one entrance and exit EA.

Figure 12A:
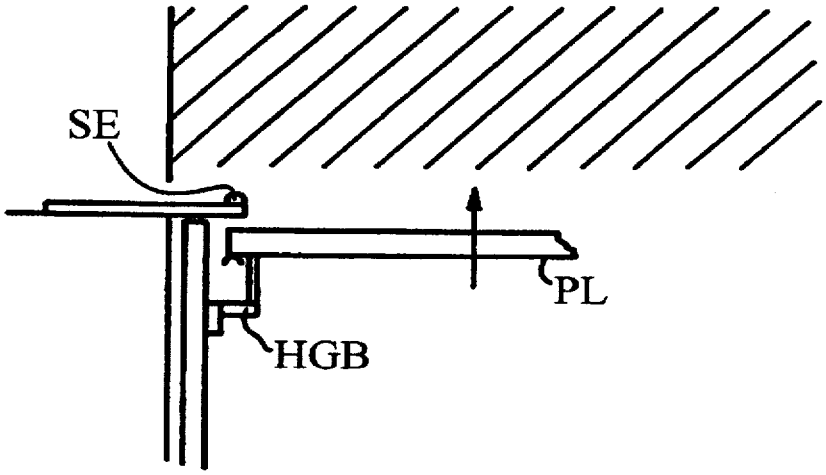
FIGS. 12*a*, 12*b* and 12*c* show, schematically, the transfer of the pallets onto a horizontal conveying level.
Figure 12B:
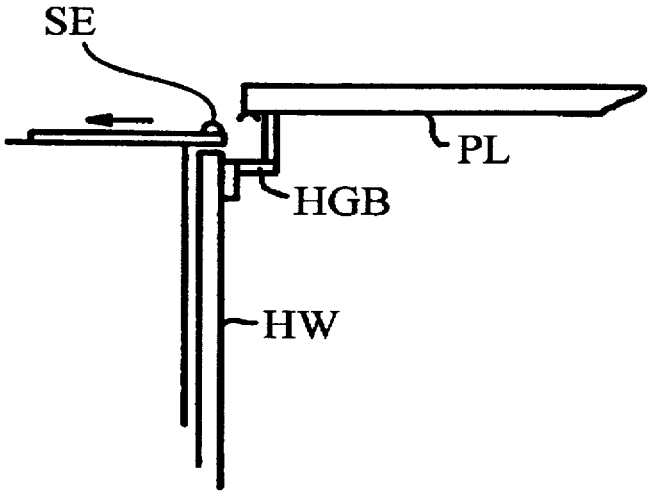
Figure 12C:
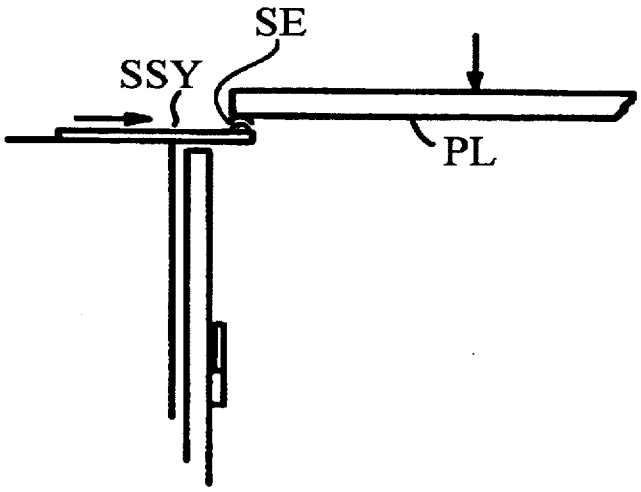
Figure 13:
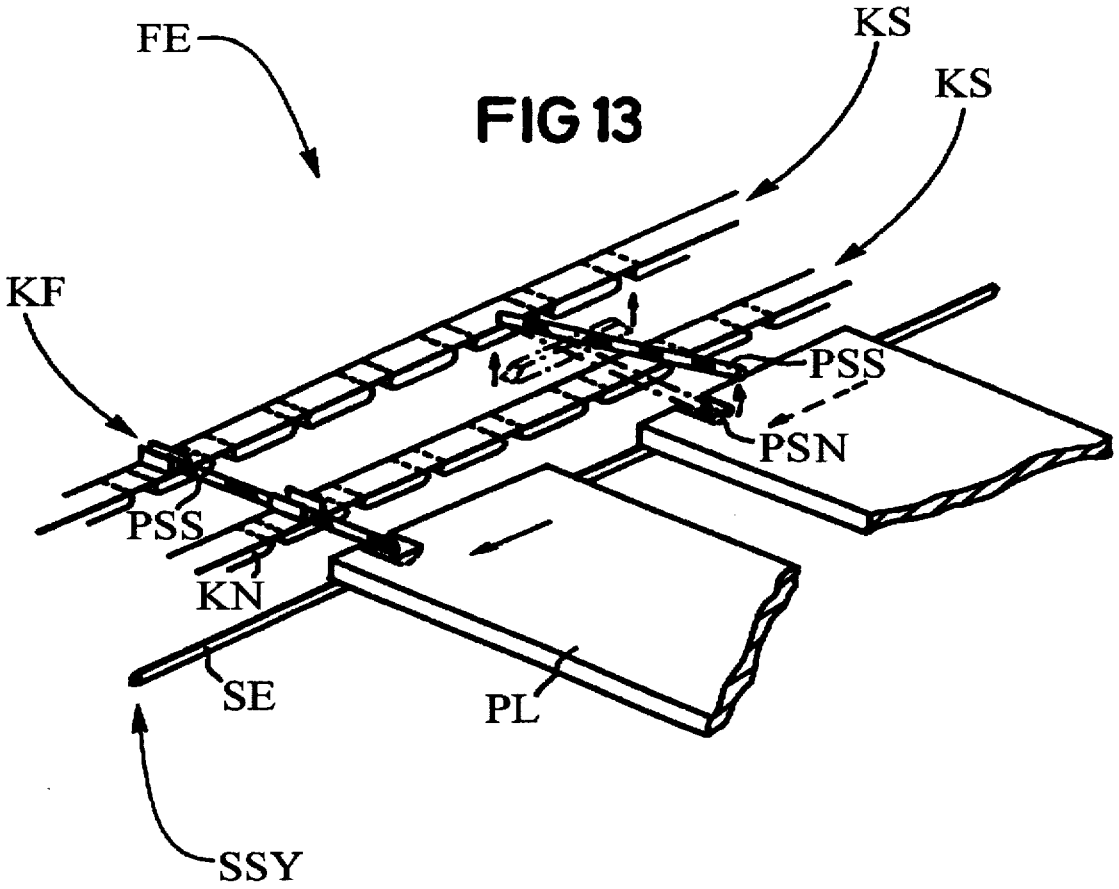
FIG. 13 shows, schematically, the horizontal conveying of the pallets with the aid of transporting chains.
Figure 14:
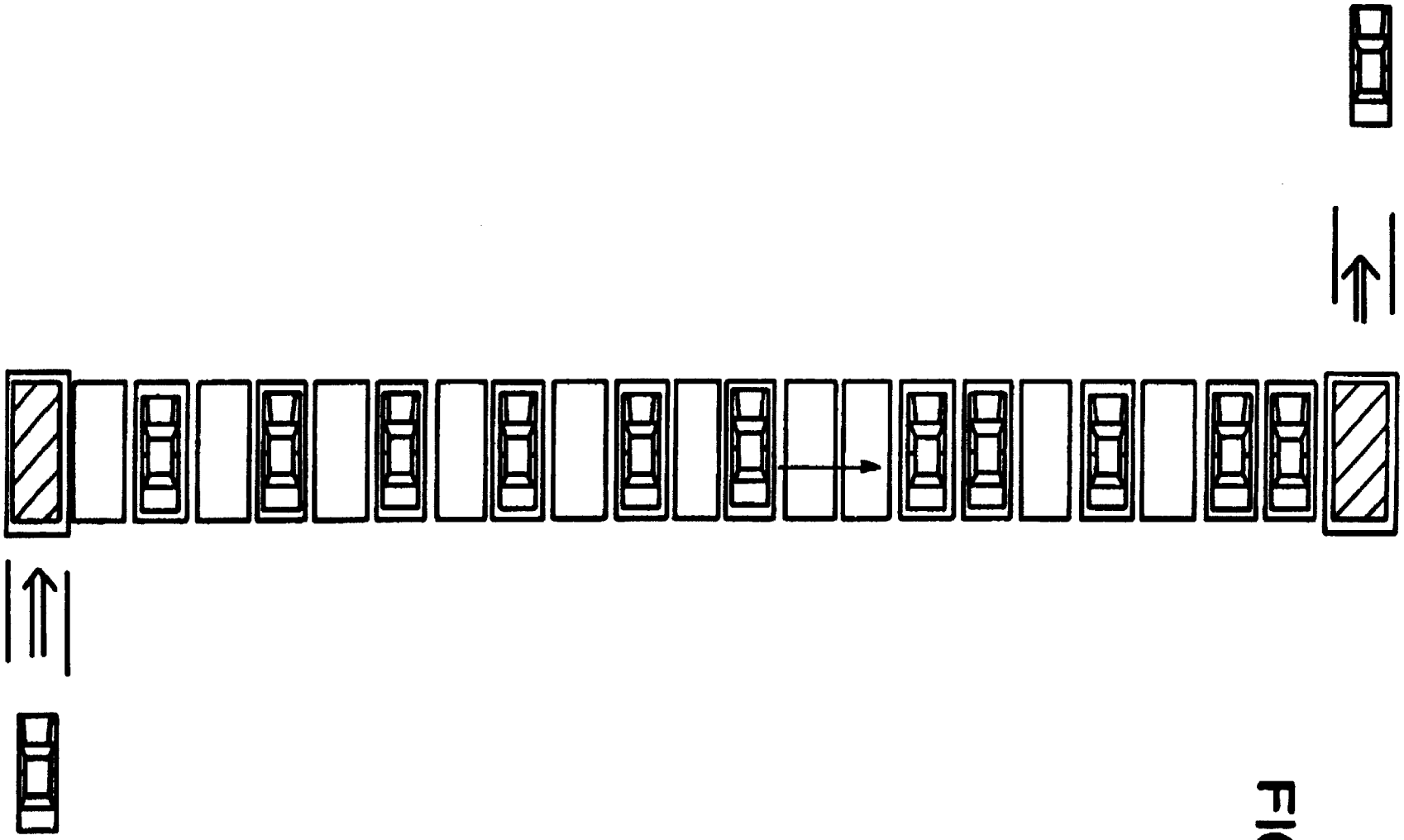
FIG. 14 shows, from above, a schematic view of an embodiment of the facility according to the invention.

According to a embodiment of the invention, at least one conveying apparatus FE such as that shown in FIGS. 11–15; for the lateral transportation of pallets PL is provided above the stacking carriages SW, it being possible for pallets to be transported, as indicated in FIGS. 14 and 22, by means of the carriages, from a lifting carriage HW to an entrance or exit EA and in the opposite direction.

In another exemplary embodiment of the invention, the conveying apparatus FE may also be arranged beneath the stacking carriages SW.

Figure 2:
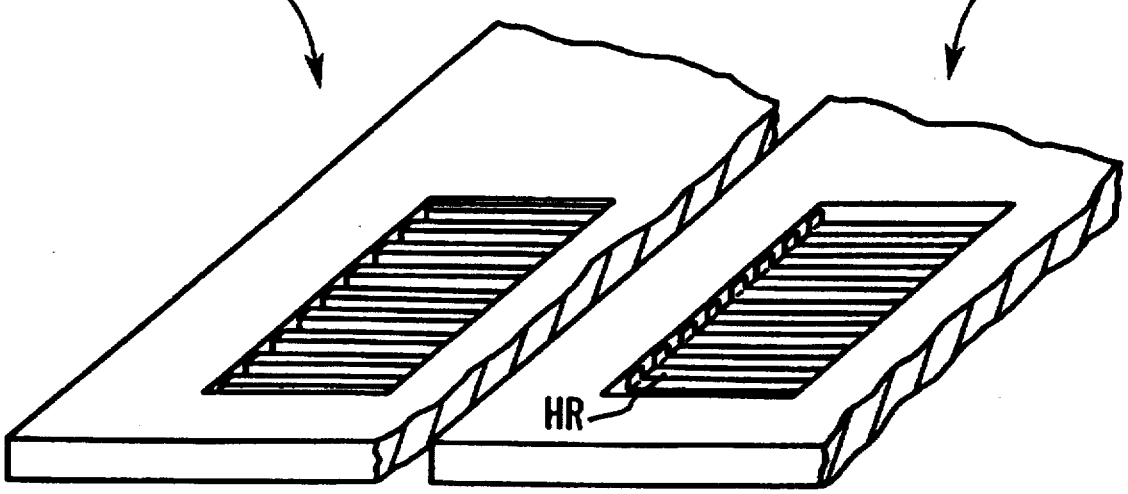
FIG. 2 shows an embodiment of a pallet having lifting grates for use in a facility according to the invention.
Figure 3:
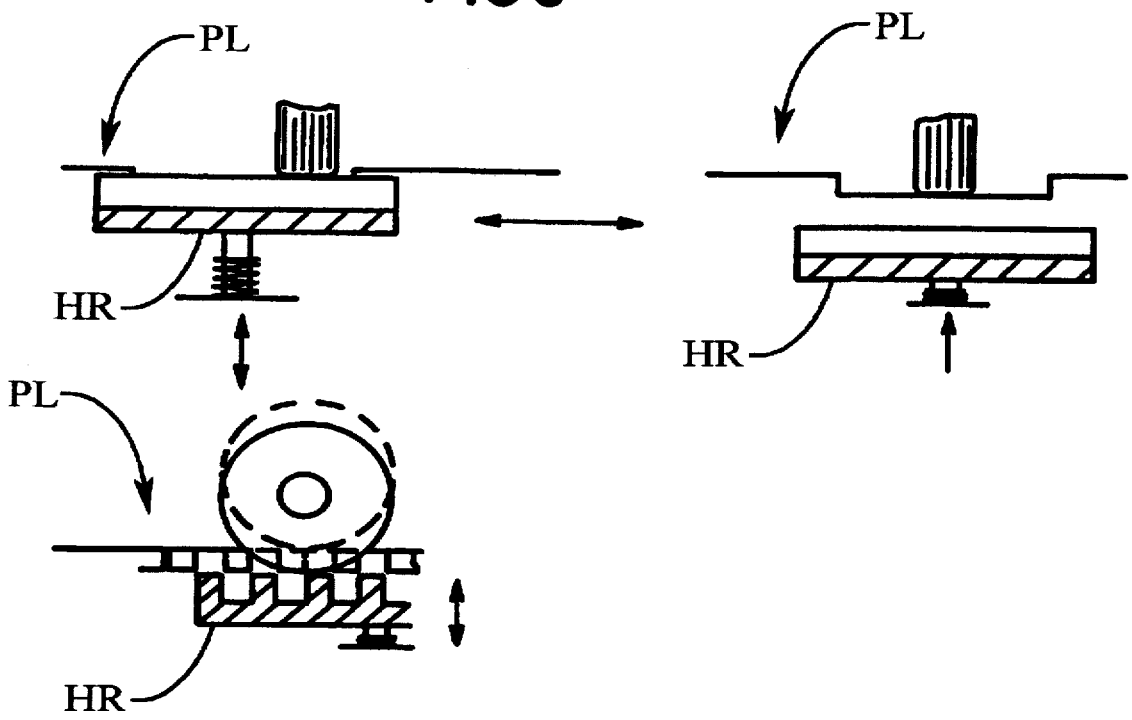
FIG. 3 shows modes of operation of lifting grates for the positioning of vehicles on pallets.

In the case of a further embodiment of the invention, such as that shown in FIGS. 2 and 3, the pallets PL have lifting grates HR which can be displaced laterally at the front and rear in the region of the vehicle axles, which can be lifted and lowered with respect to the pallet plane and with the aid of which the central position of the parked vehicle in the transverse direction of the pallet can be produced, by displacing the lifting grates.

Figure 4:
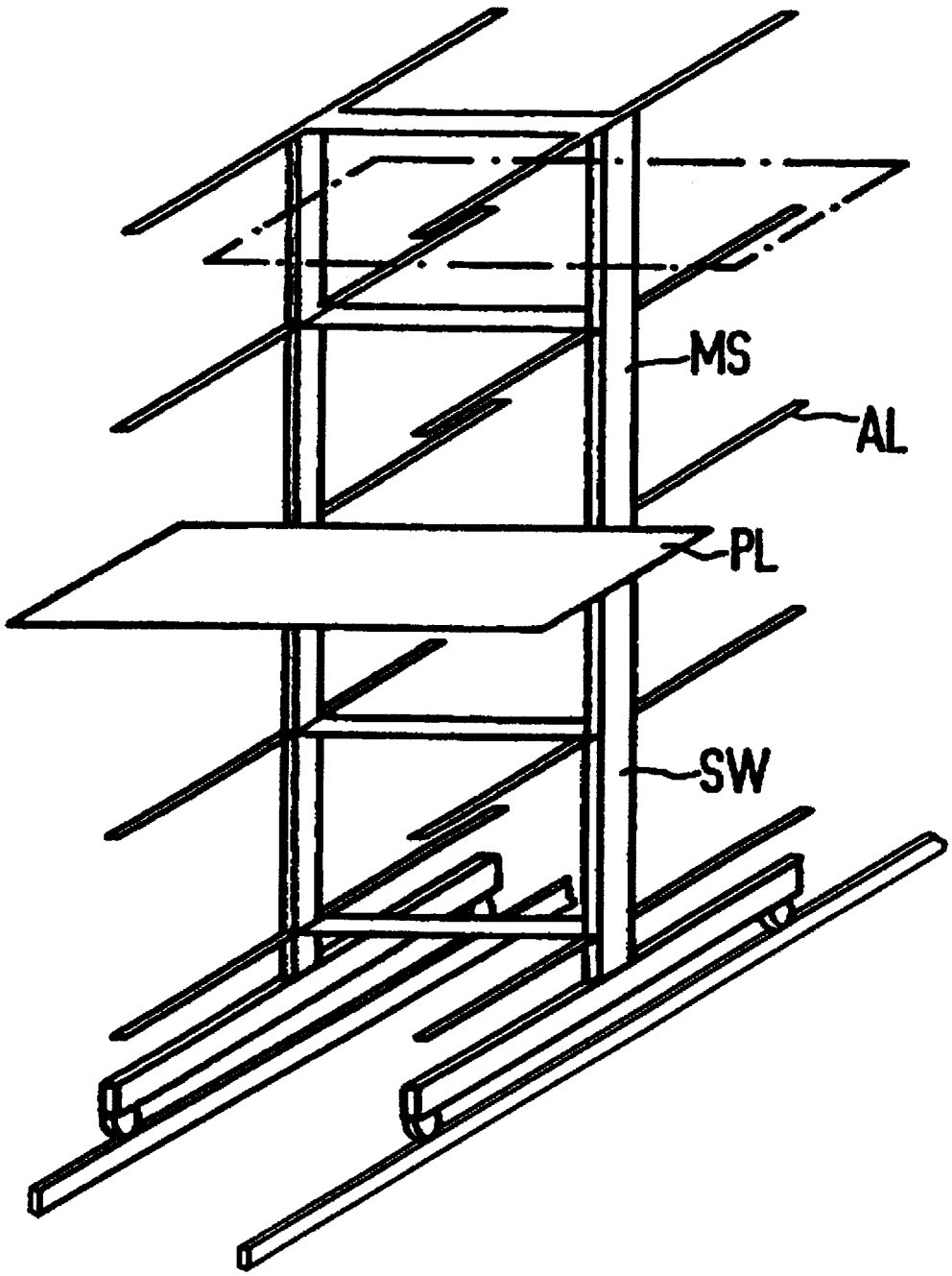
FIG. 4 shows a stacking carriage for forming the facility according to the invention.

As illustrated in FIG. 4, a embodiment of the invention provides that the stacking carriages SW are configured as steel structures which, on both sides of central uprights MS, can receive pallets PL on extension arms AL.

In this arrangement, it is particularly advantageous if the stacking carriages SW travel on rails.

Figure 5:
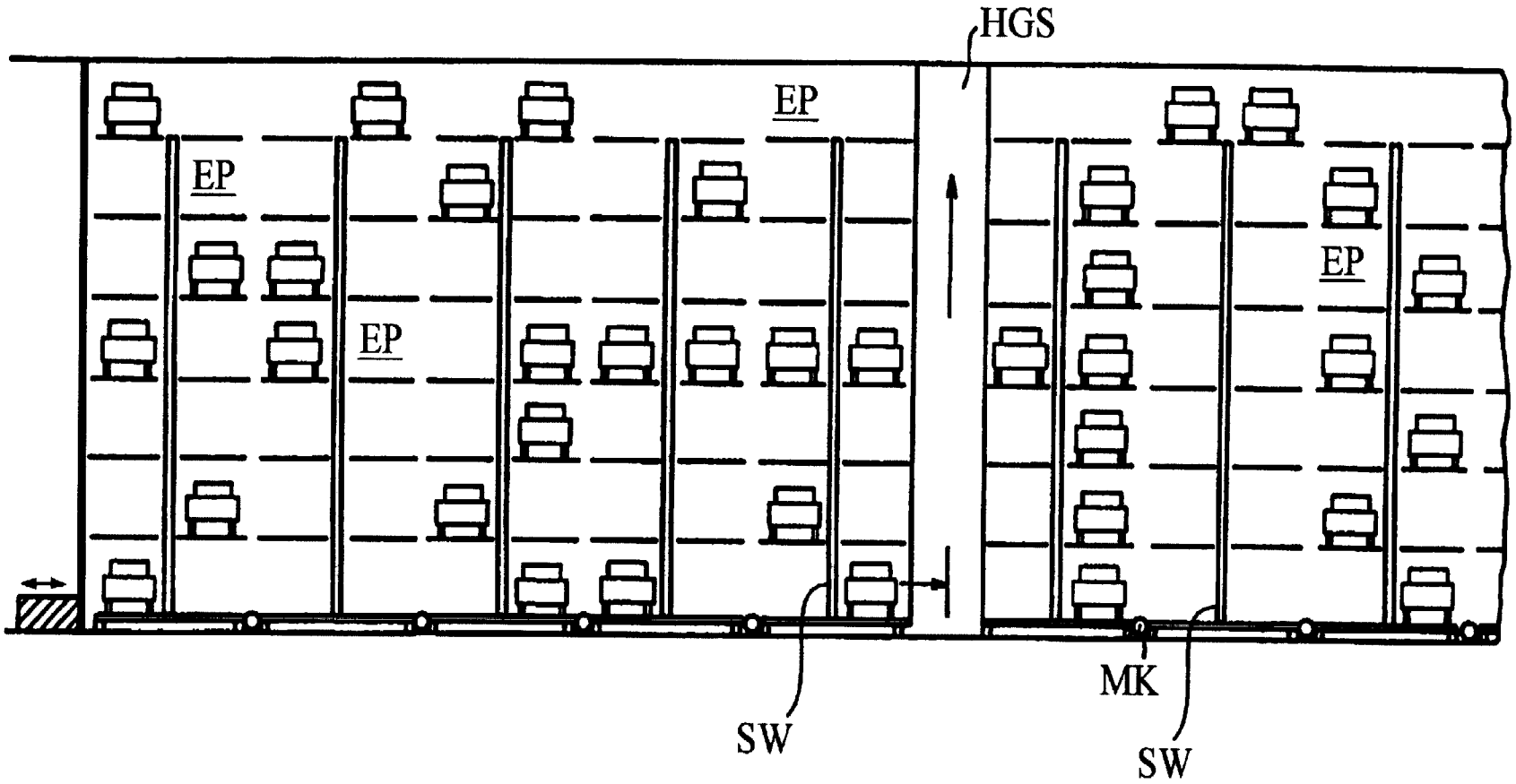
FIG. 5 shows a cross-section through an embodiment of the facility according to the invention.
Figure 6:
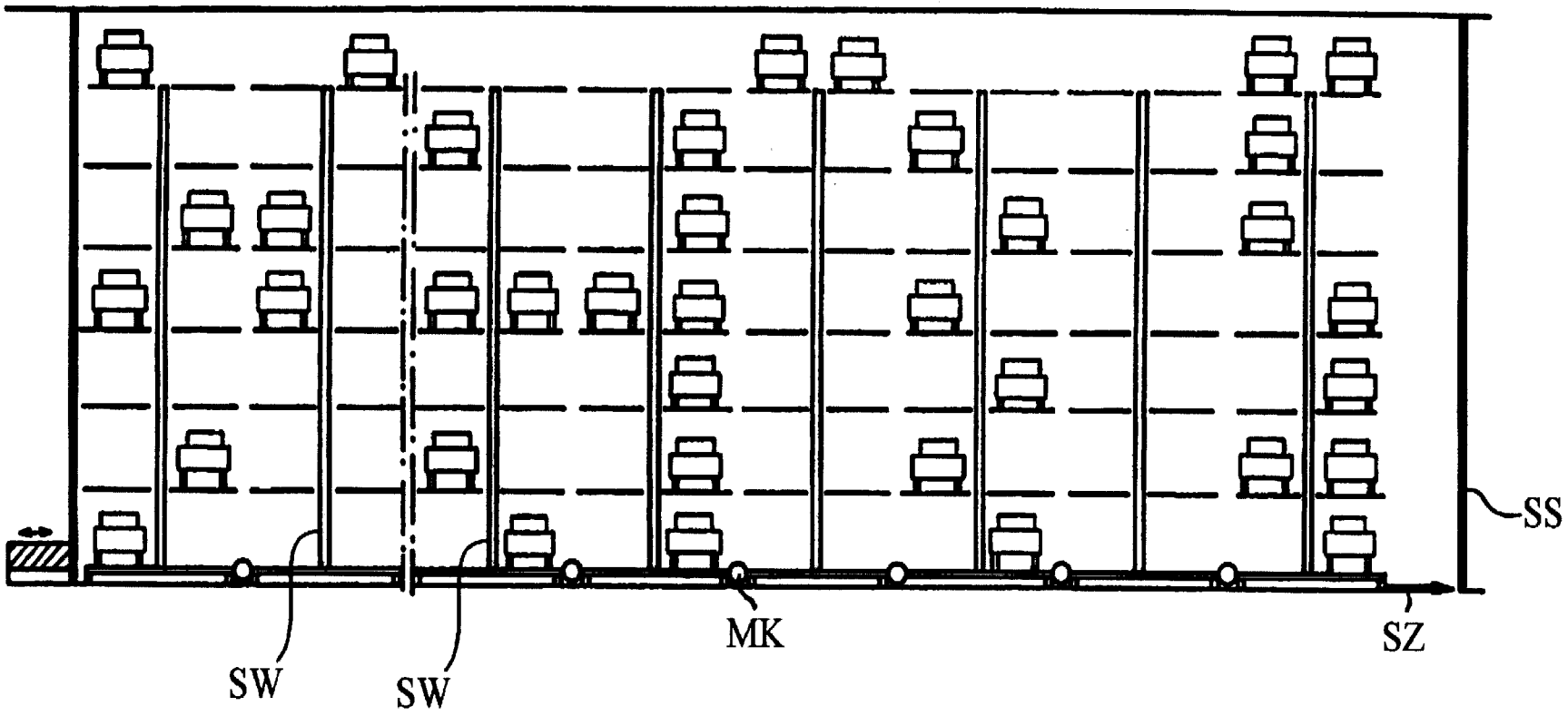
FIG. 6 shows a further cross-section through an embodiment of the facility according to the invention.
Figure 7:
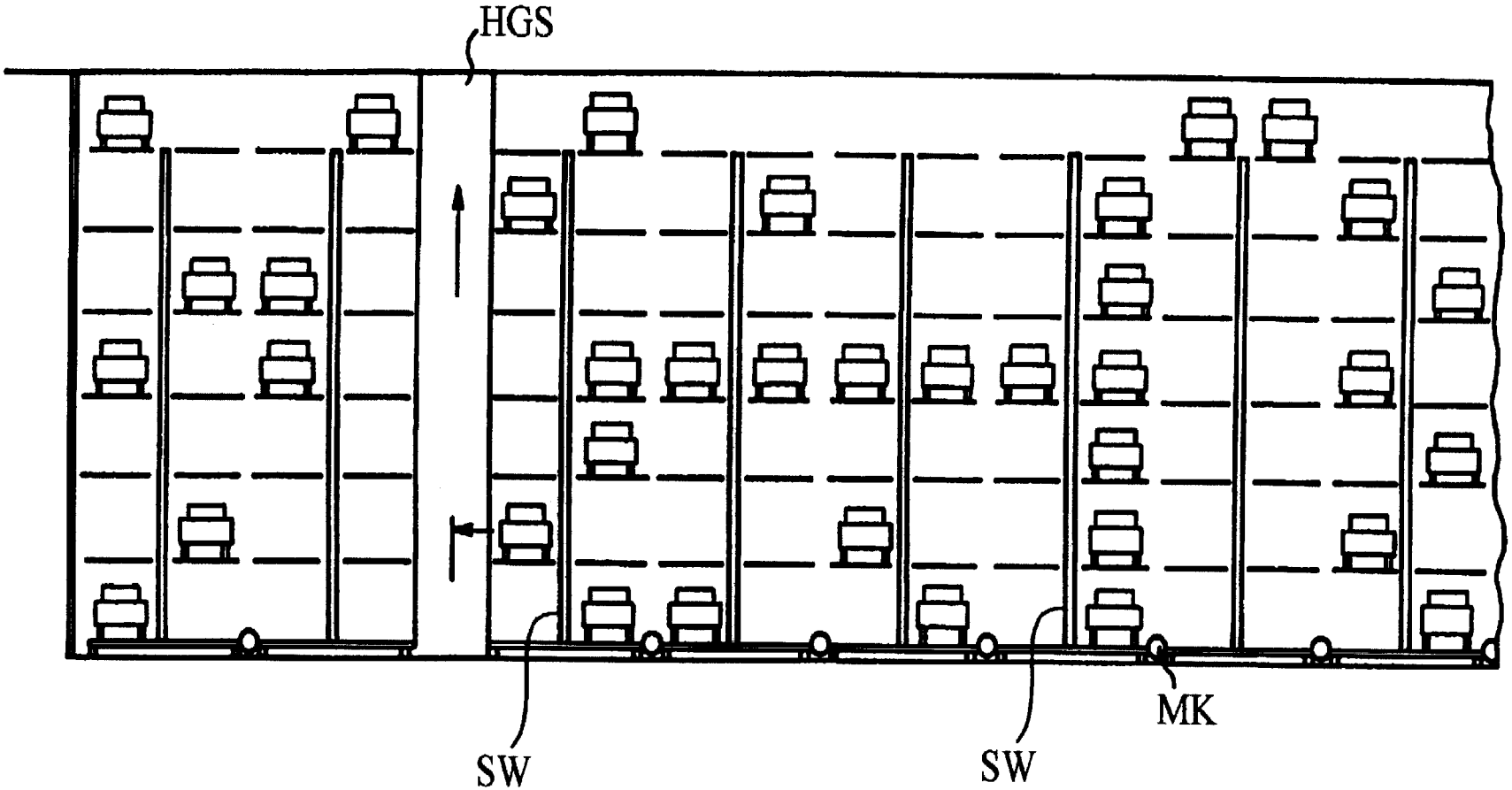
FIG. 7 shows a further cross-section through an embodiment of the facility according to the invention.
Figure 8:
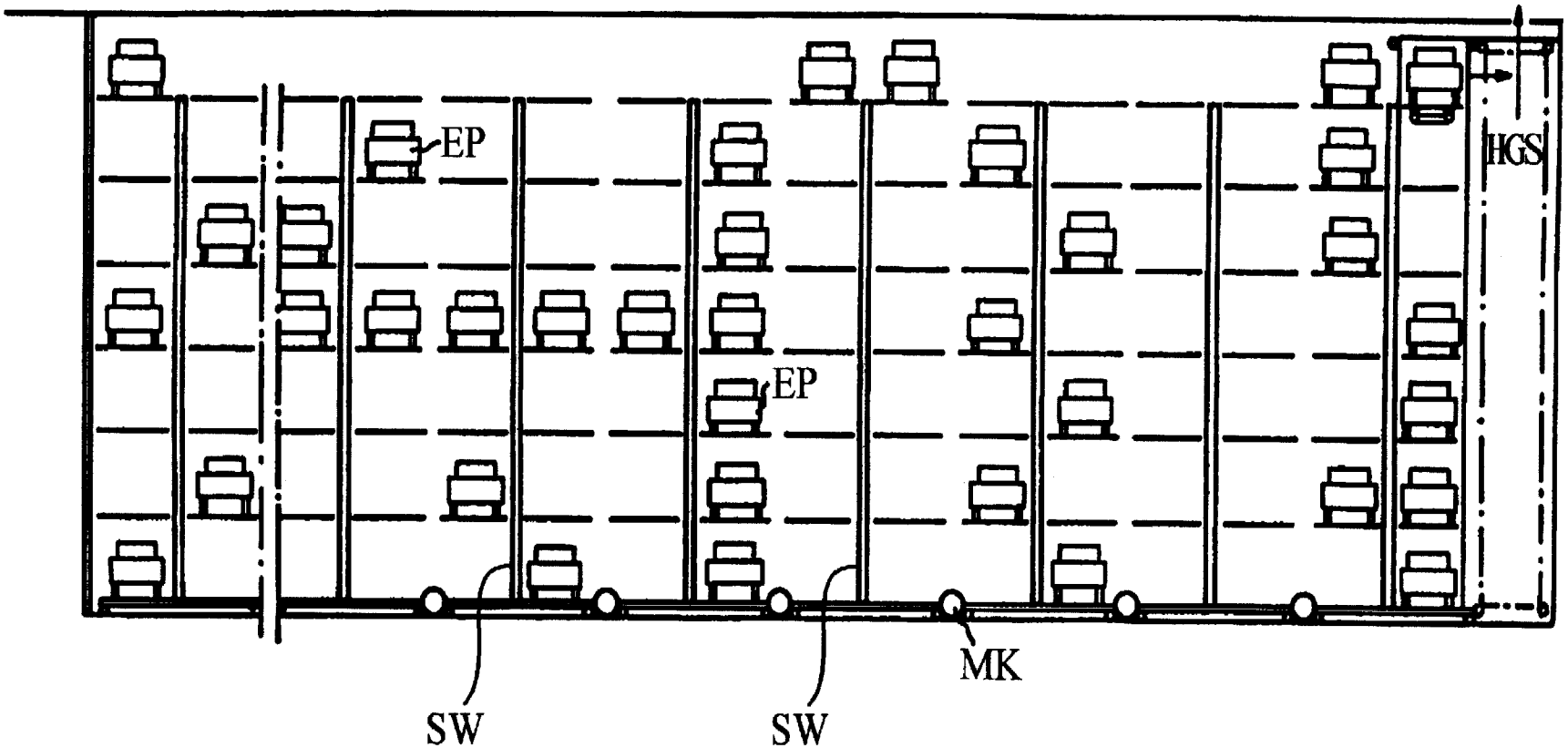
FIG. 8 shows a further cross-section through an embodiment of the facility according to the invention.

Furthermore as illustrated in FIGS 5–8, it is particularly advantageous if the stacking carriages can be connected to one another via magnetic couplings MK. In the case of a preferred embodiment of the invention, it is further provided that on the end sides of the facility according to the invention there are provided push and pull rods SZ, for example, as indicated in FIG. 6, by means of which the stacking carriages SW can be displaced laterally.

Figure 9:
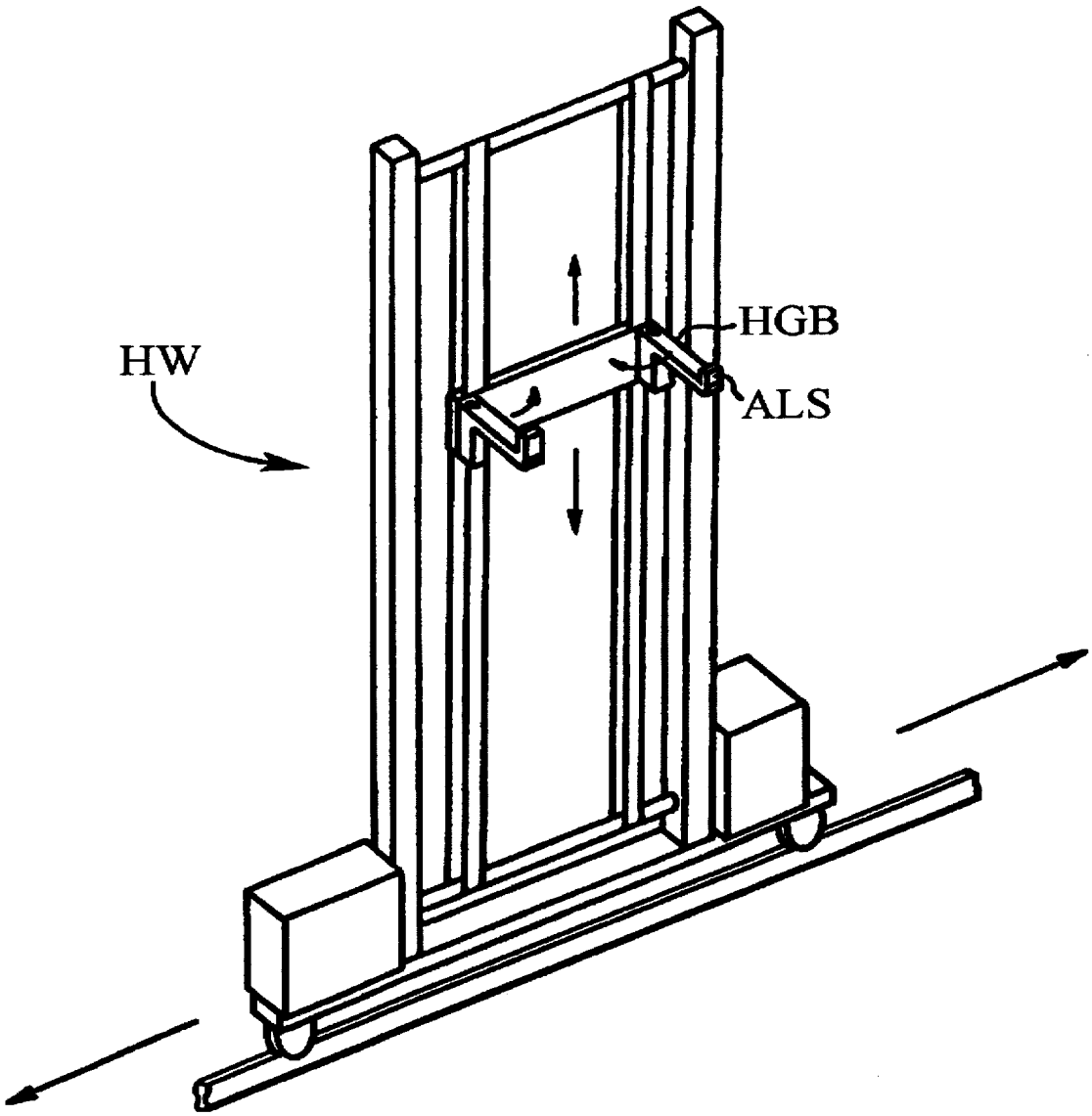
FIG. 9 shows a detail of a lifting carriage of the facility according to the invention.
Figure 10:
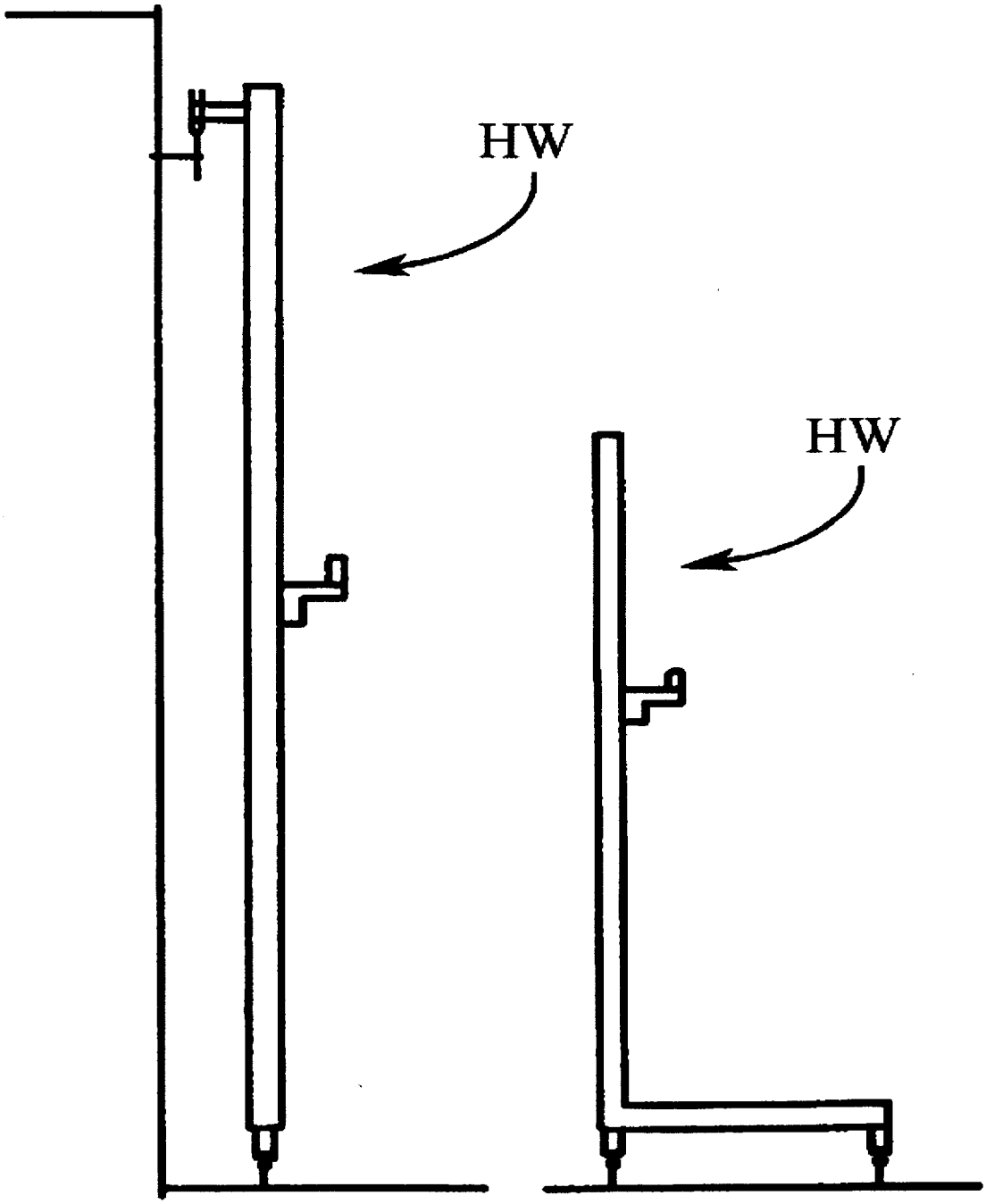
FIG. 10 shows a further detail of an embodiment of a lifting apparatus of the facility according to the invention.

According to a further embodiment of the invention, it is provided that the lifting carriages HW travel independently on rails over the entire length of the facility, on both sides of the stacking carriages SW. In this arrangement, it is particularly advantageous if the lifting carriages HW are equipped with a lifting fork HGB having pivotable extension arms ALS, as illustrated in FIG. 9.

As shown, for example, in FIGS. 12 and 13, in the case of a further embodiment according to the invention, the conveying apparatus FE includes a rail system SSY, made up of rail elements SE, and a chain conveyor KF made up of two parallel chain systems KS with chains KN on which there are provided pallet push rods PSS which engage in pushing niches PSN of the pallets and convey said pallets PL.

In the case of an embodiment of the invention, as shown in FIG. 3, the lifting grates are mounted on a hydraulic cylinder and can be lifted and lowered with the aid of the hydraulic cylinder. The horizontal displacement can take place on a rolling or sliding level via hydraulic cylinders. All four grates per pallet (one grate per vehicle wheel) can be moved independently of one another.

In the case of a further embodiment of the invention, the magnetic couplings MK are configured in the form of two steel plates which are located opposite one another and, for force transmission, are magnetized with the aid of suitable electromagnets.

In the case of an embodiment of the invention, as shown, for example, in FIG. 13, the chain conveyors, which serve for transporting the pallets further in the horizontal direction, are designed in the form of two parallel chains (e.g. in accordance with the chain principle of a bicycle chain) which absorb the moment resulting from the conveying rod.

In this arrangement, the pallet push rod PSS (driver rod) is mounted on the chains. The pushing niche PSN merely a cutout in the frame of the pallet PL. The force transmission from the driver rod to the pallet takes place via said niche.

Figure 20:
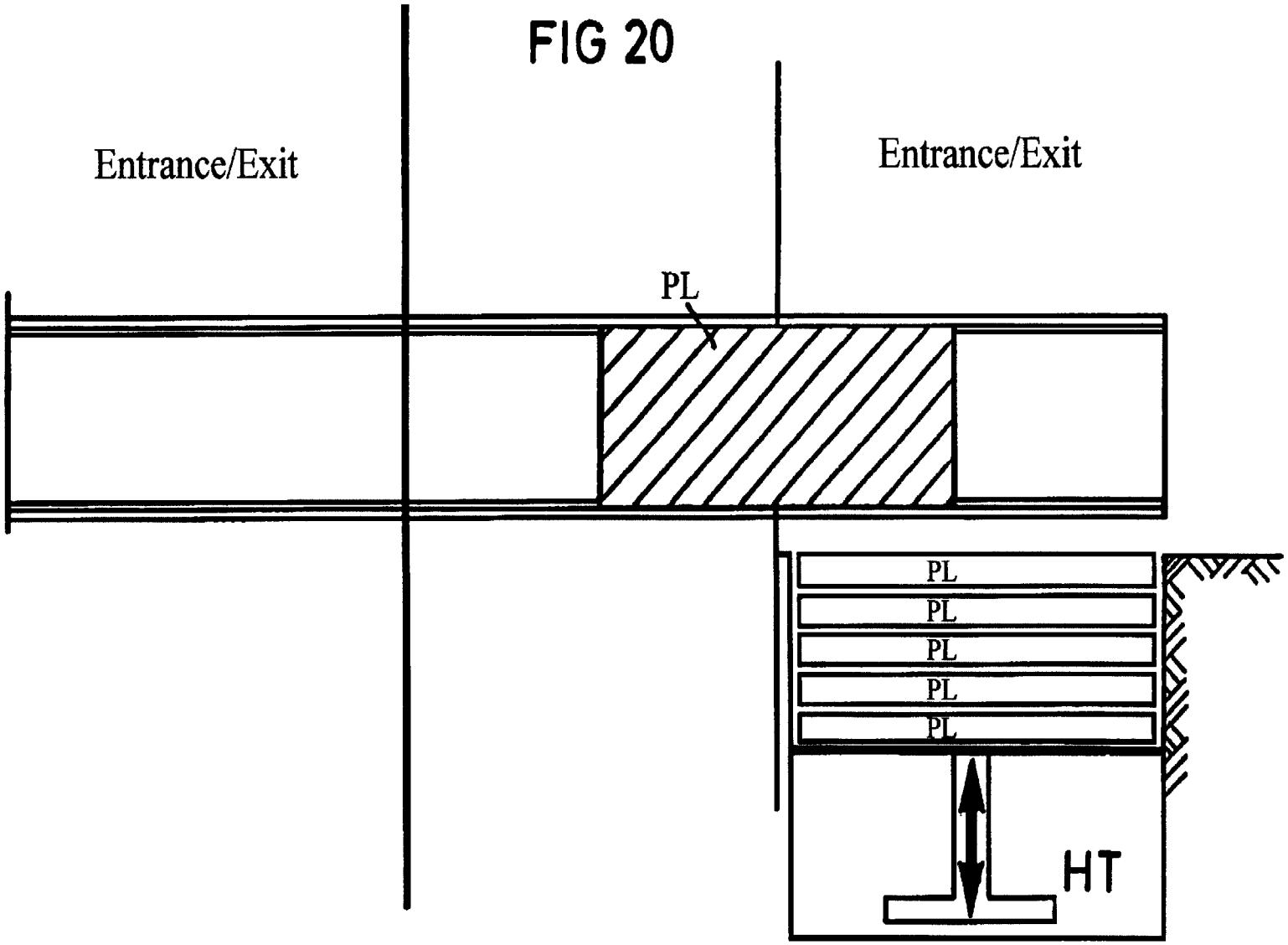
FIG. 20 shows, schematically, the arrangement of pallets, beneath an entrance/exit position, on a lifting table.
Figure 21:
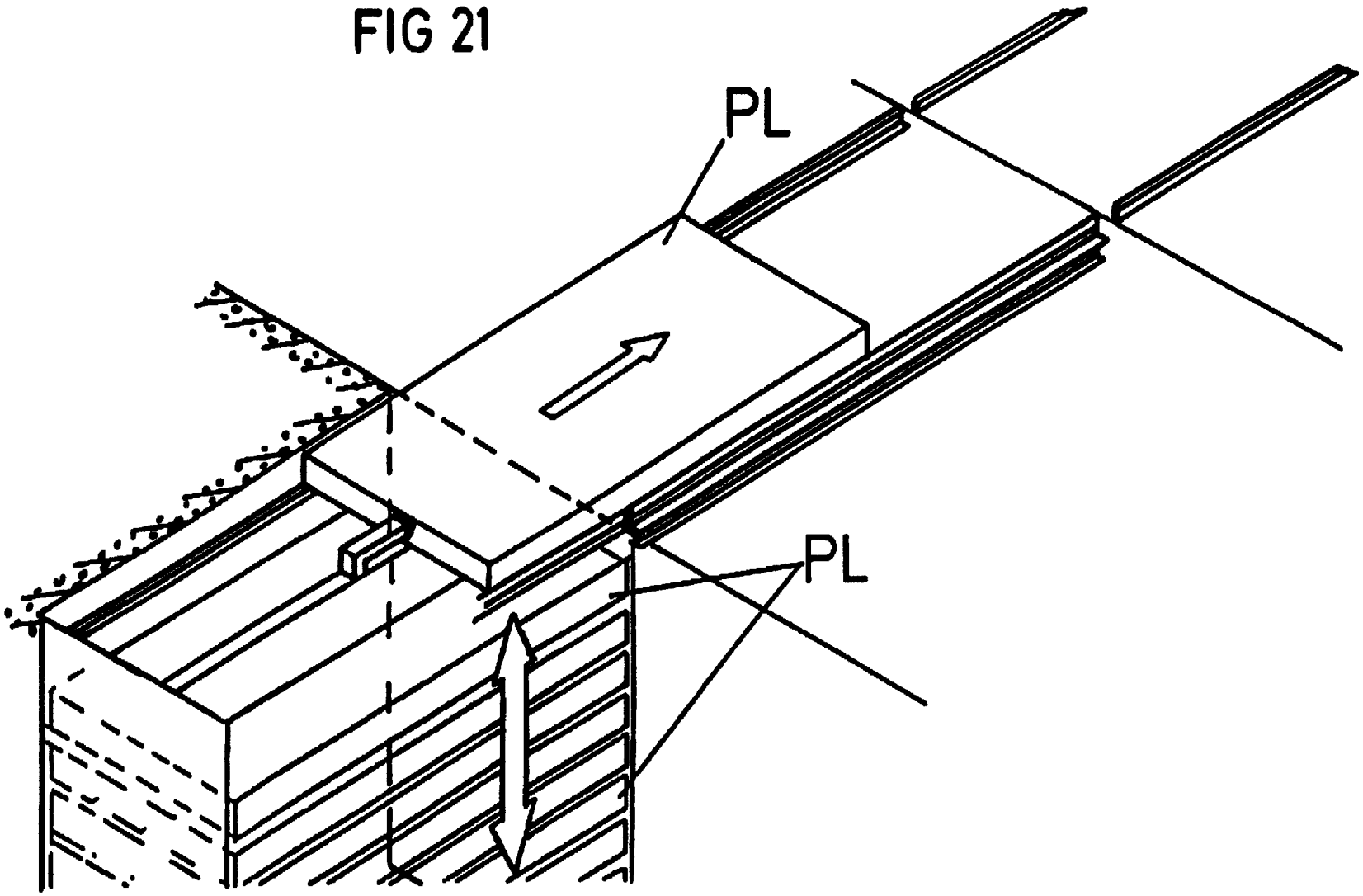
FIG. 21 shows, schematically, stacked pallets in an exemplary embodiment of the facility according to the invention.

According to a further embodiment of the facility according to the invention, means for the intermediate storage of temporarily non-required pallets are provided outside the storage and retrieval carriages. The means are designed preferably in the form of stack-type stores with lifting tables (HT) for receiving and/or releasing pallets PL, such as shown in FIGS. 20 and 21. By virtue of this measure, temporarily non-required pallets do not have to be moved back into the storage systems (storage and retrieval carriages), but can be kept in store outside the storage systems.

Figure 1:
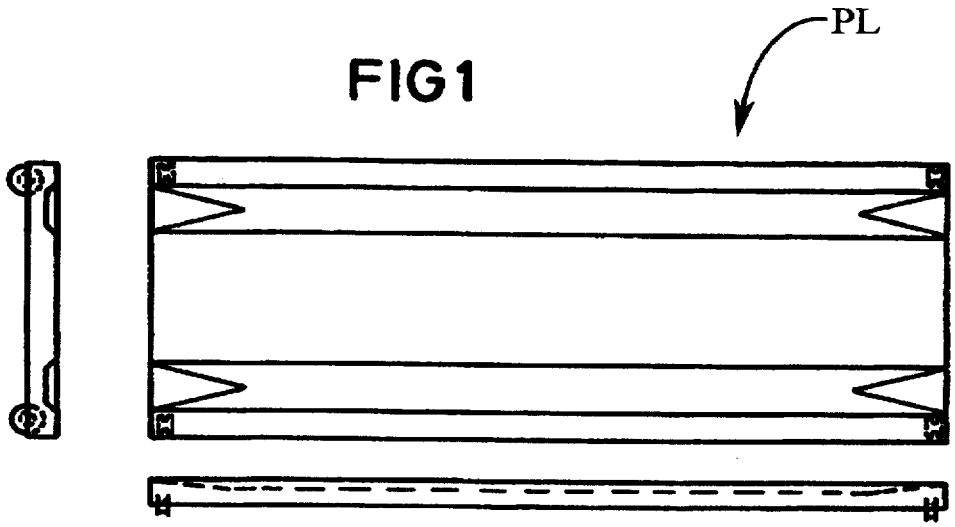
FIG. 1 shows an embodiment of a pallet for use in the facility according to the invention.

FIG. 1 shows a first embodiment of a pallet PL as is used in conjunction with the facility according to the invention and is a constituent part of the facility according to the invention. According to a preferred exemplary embodiment of the facility according to the invention, the pallets have, for example, dimensions of 2.10 m×5.10 m. In this arrangement, due to the structure of the facility according to the invention, side clearances for getting in and out can be dispensed with.

The first embodiment of the pallet, as illustrated in FIG. 1 can be designed as a channeled metal plate with predetermined tracking e.g., predetermined by a colored marking or with access, or lowering of the track. The precise position of the vehicle on the plate in the transverse direction is not critical, but general centering is desirable.

In the longitudinal direction, photocells sense the length of the vehicle when driven onto the pallet. The desired parking position in the longitudinal direction is indicated optically. The vehicle is parked with the parking brake, so that the driver can then leave the vehicle.

FIG. 2 shows a second embodiment of the pallets, which embodiment is designed, in principle, just as the pallet of FIG. 1, but with lifting grates being provided at the front and rear of the pallet in the region of the axles. After parking of the vehicle, the vehicle is centered in the transverse direction automatically with the facility according to the invention. In this arrangement, the lifting grates are displaced horizontally until the vehicle is centered and, thereafter, the lifting grates are lowered in order to fix the vehicle in place. By virtue of this measure, the pallet width can be reduced with respect to the width of the pallets of the first embodiment. In this arrangement, a vehicle can be driven onto the pallet without any difficulty at all.

As is represented schematically in FIG. 1, all the pallets PL are provided with rollers in the corners. As represented in FIG. 3, the pallets are deposited in stacking carriages. The stacking carriages SW are steel structures which, on both sides of the central uprights MS, can receive the pallets PL on extension arms AL. In this arrangement, the distance between extension arms located one above the other is preferably 2.20 m. The stacking carriages run on rails. The number of stacking levels is given by the overall set-up of the facility according to the invention, but is preferably a maximum of from 6 to 8 levels.

As is shown in FIG. 5, the facility according to the invention comprises a plurality of stacking carriages SW (e.g. 10 stacking carriages) which are located one beside the other and are connected via magnetic couplings MK (FIG. 5). On a surface area of approximately 51 m×7 m, corresponding to 357 m2, for example 20 vehicles can be accommodated on each level, i.e. approximately 140 vehicles in the case of, for example, 7 levels.

One lifting passage HGS is preferably provided for every 10 stacking carriages. The number of lifting passages defines the conveying capacity of the installation. Thus, in order to change the conveying capacity of the installation, a different number of lifting passages can be provided. On the end sides SS of the installation there are provided push and pull rods SZ, by means of which the stacking carriages SW can be displaced on the rails. It can be seen from FIGS. 5, 6, 7 and 8 how a lifting passage HGS can be opened at any desired location, i.e. between any pair of stacking carriages, by pushing selected stacking carriages together, closing the respective magnetic couplings NK, opening the magnetic coupling in the region of the desired lifting passage, and opening the lifting passage HGS by pulling the stacking carriages.

Lifting installations are available for lifting the pallets with the vehicles, which lifting installations run on rails, on both sides of the stacking carriages, and can travel independently over the entire length of the installation. As is represented in FIG. 9 and in FIG. 10, the lifting carriages have a chain-driven lifting apparatus with a lifting fork which is equipped with pivotable extension arms in order to allow the lifting carriages to travel in front of the stacking carriages. Depending on the number of stacking levels, the carriages are guided additionally via rollers in the upper region or may be designed as independently travelling units.

The operations of the lifting apparatus are represented schematically in FIGS. 11 and 12*a–c*. As the lifting passage is produced, the lifting carriage travels into the position of the selected pallet. The extension arms of the lifting fork are then swung open. The lifting fork engages the pallet from beneath. The pallet is moved sideways out of the rack, and, at the same time, the lifting passage is produced and, in the lifting passage, the pallets are moved onto street level (+–0.0 level).

Figure 11:
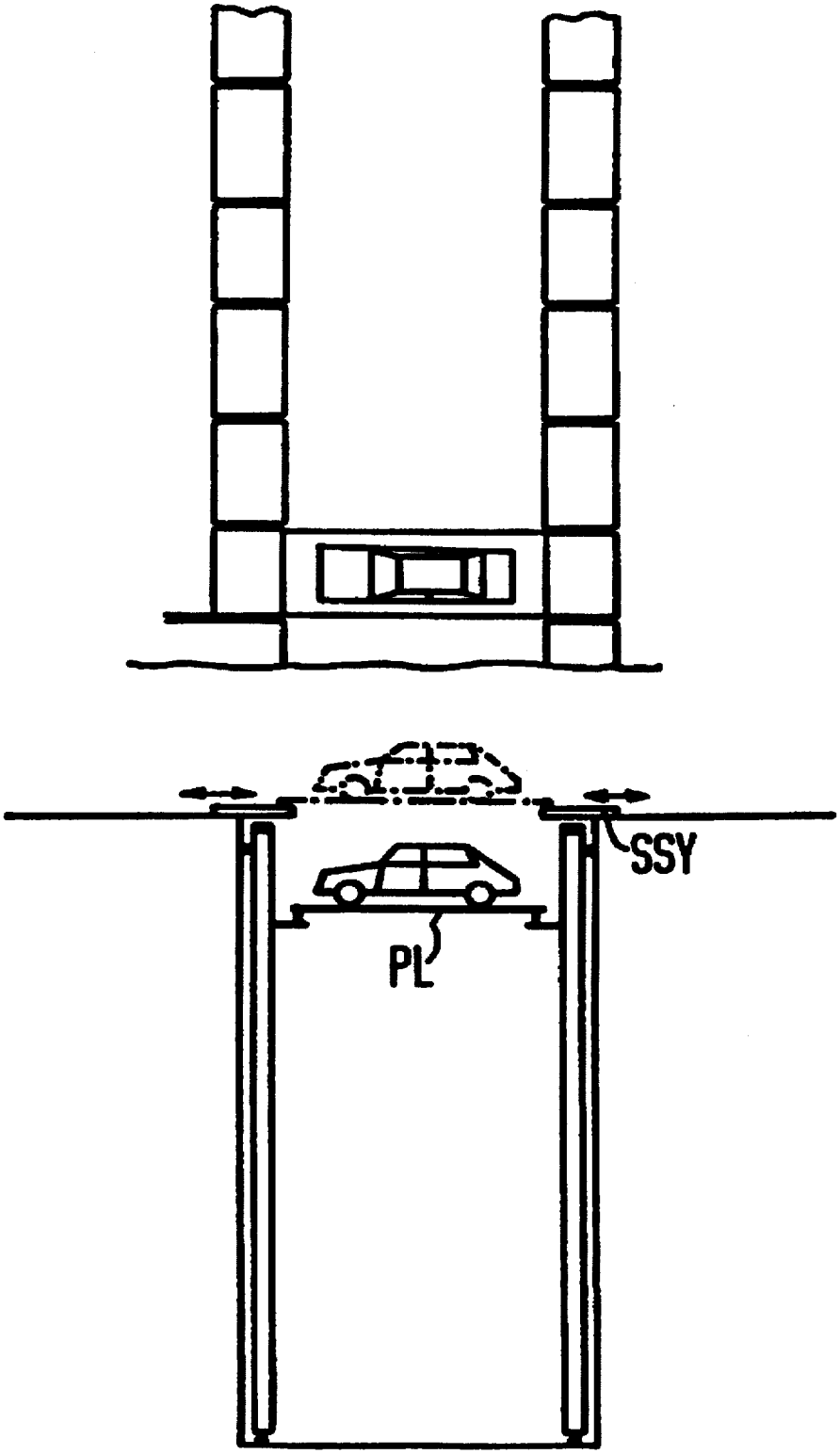
FIG. 11 shows a schematic representation of the transfer of the motor vehicles onto street level in accordance with the facility according to the invention.

FIG. 11 shows, schematically, the transfer of the vehicles on the pallets onto road level (+–0.0 level). The rail system SSY on the +–0.0 level comprises individual pieces of a length of approximately 2.40 m. For transfer, the rail piece, in the region of the lifting passage, is moved outwards. The pallet is lifted over the rail upper edge (FIG. 12*b*). The rail piece is moved back into the initial position (FIG. 12*c*). The pallet is, finally, deposited on the rail element via the rollers.

After the transfer, the pallet is transported, on the rails, horizontally to the end of the installation, preferably via laterally running chain conveyors (FIG. 13). The chain conveyor KF comprises two parallel chain systems KF on both sides of the horizontal displacement path. On the chains there are provided push rods PSS which engage into the pushing niches PSN of the pallets PL and convey the pallets. Pallets PL to be removed from storage and pallets PL to be introduced into storage travel on one route.

If the pallet to be introduced into storage is intended to be stopped for the purpose of lowering it, the push rod is disengaged from the pallet, and further conveying of other pallets may be continued.

Figure 15:
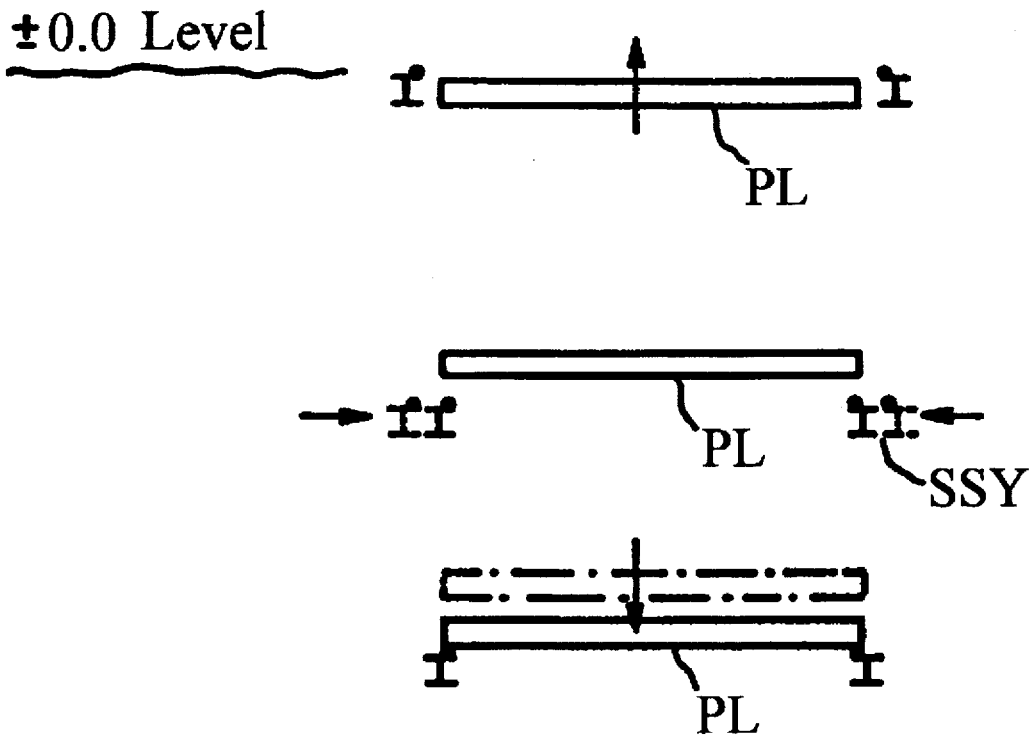
FIG. 15 shows, schematically, the transfer of the pallets from the lifting carriage onto the apparatus for displacement into the side regions of the facility according to the invention.
Figure 16:
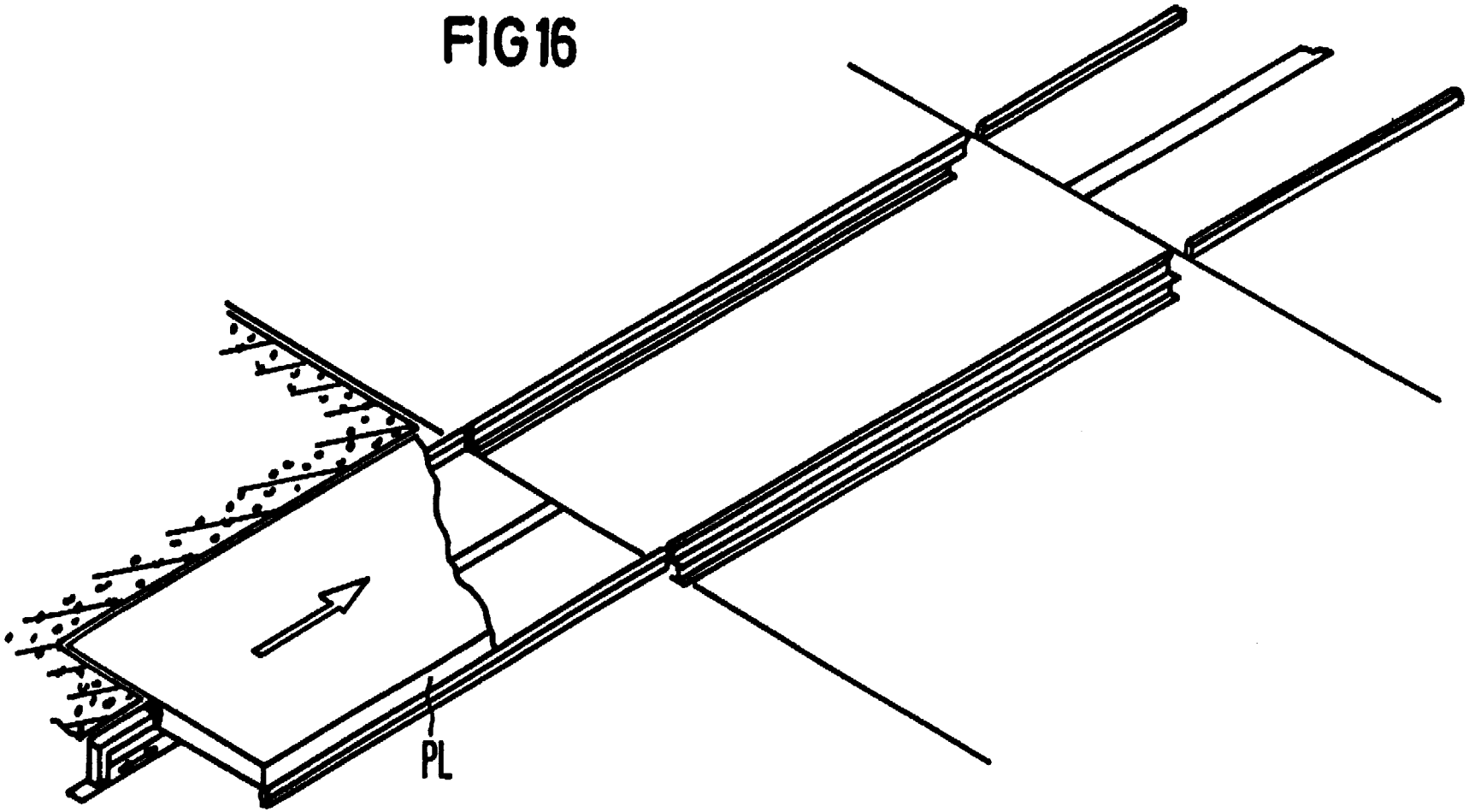
FIGS. 16, 17 and 18 show, schematically, the pallets displacement during operation of the facility according to the invention.
Figure 17:
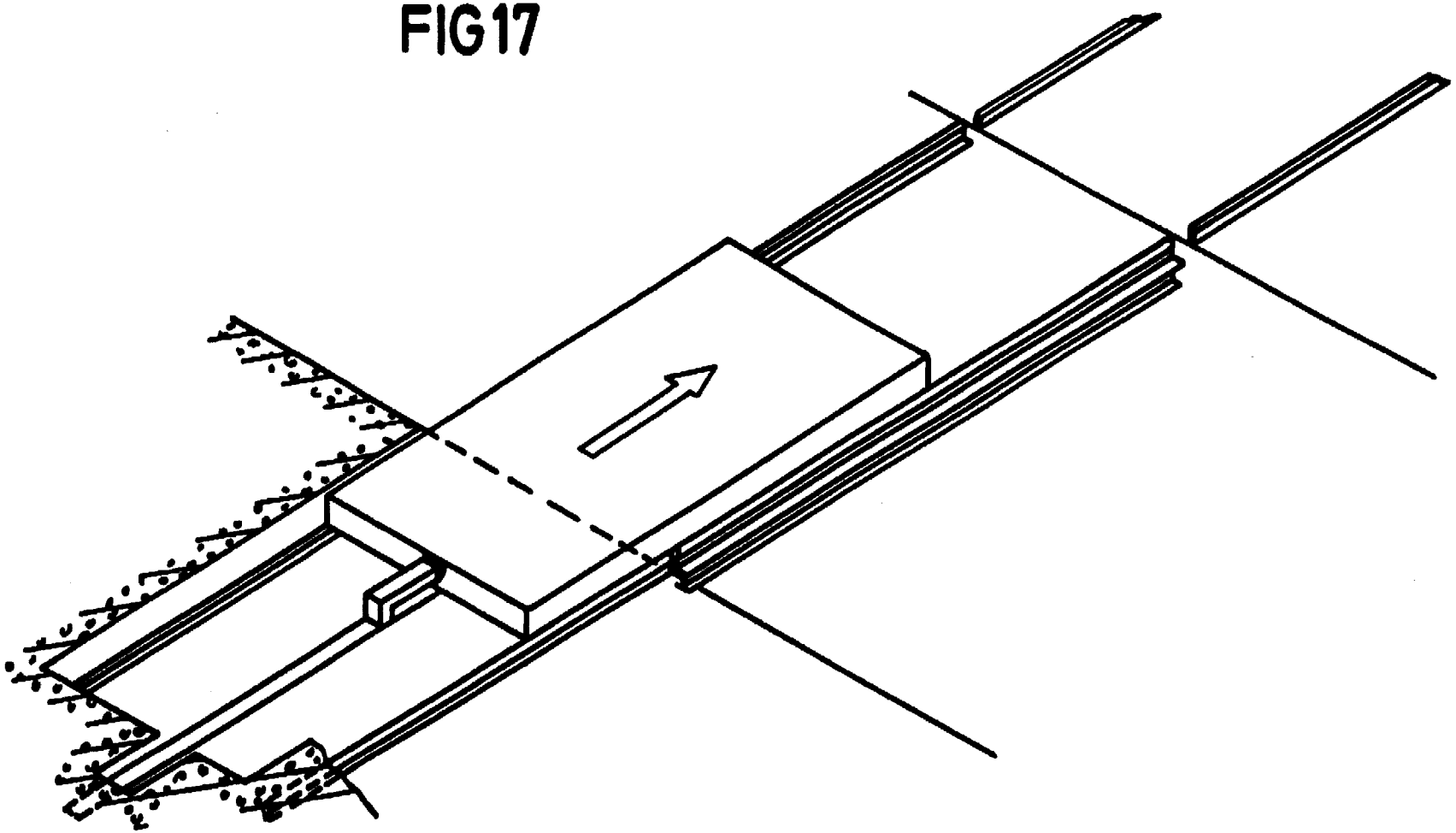
Figure 18:
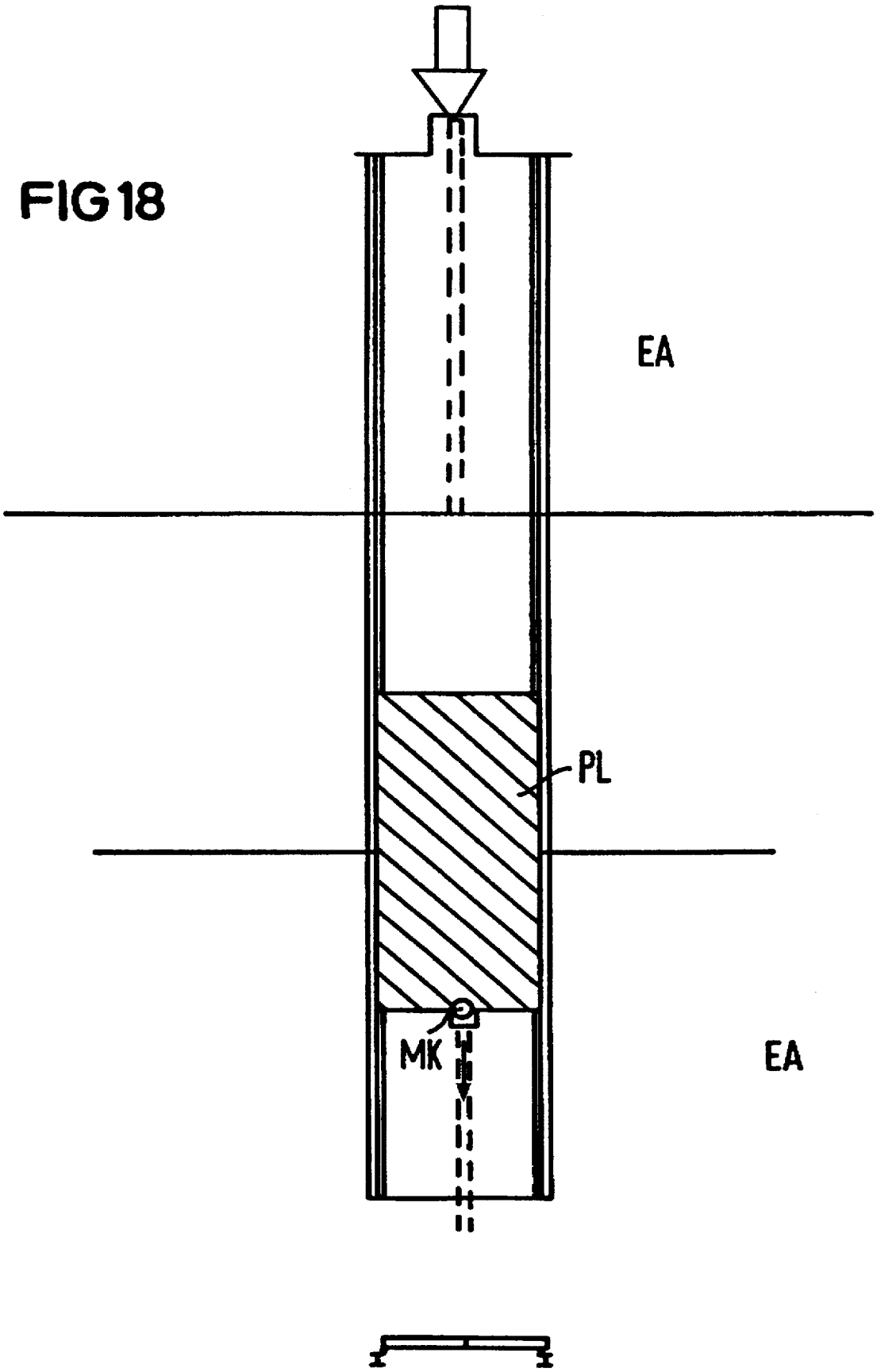
Figure 19:
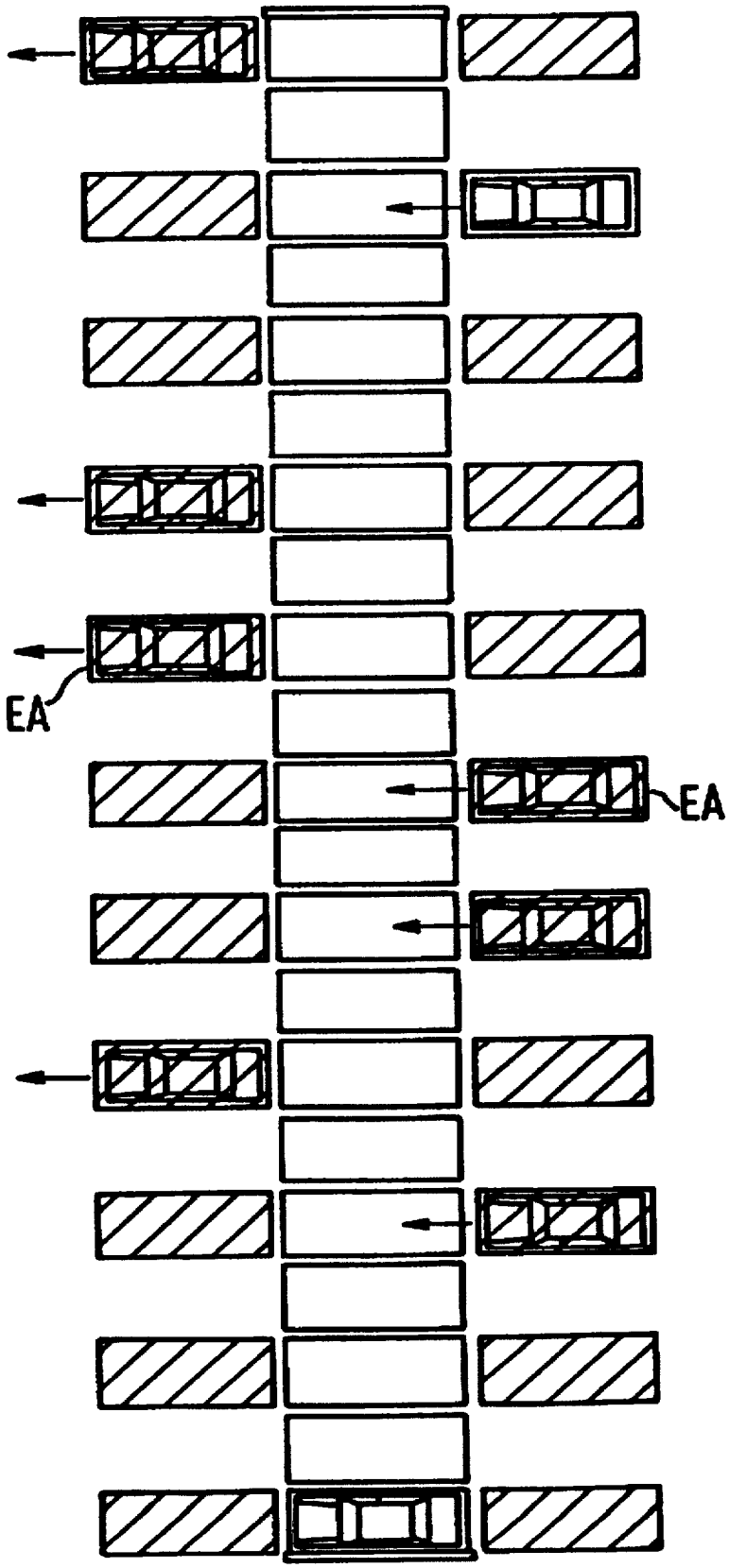
FIG. 19 shows, schematically, from above, a view of an embodiment of the facility according to the invention.

In order to move the pallets out of the central region into the side regions, the pallets are lifted over the +–0.0 level (street level). As is represented in FIG. 15, carriers with rails move beneath the pallet rollers. Thereafter, the pallets are deposited on the rails. Finally, the pallets are shifted by a chain-driven pushing unit which is connected preferably by a magnetic coupling.

With the arrangement of an entrance or exit (EA) for the storage systems, it is advantageous if pallets which are not required at any given moment do not have to be moved back into the storage systems, but can be kept in store elsewhere until they are required. By virtue of such a measure, the access speed in the parking system can be further improved.

For this purpose, in a preferred exemplary embodiment of the invention, lifting tables (HT) are arranged beneath the entrances and/or exits (EA), which lifting tables, in the case of an excess of pallets, are lowered and thus introduce pallets into storage and, in the case of a lack of pallets, can make elements available to the system again (FIGS. 20, 21, 22). Lifting tables of this type are known in the art, including lifting tables having electric drives.

In the case of longitudinal transportation of pallets (FIG. 14), a return or feed of pallets from the exit station to the entrance station is advantageous (FIG. 22). In this arrangement, the pallets are moved, for example, via vertical and horizontal chain conveyors. The stacking-up (storing) of the pallets takes place here preferably within the chain conveyor systems.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A parking facility having at least one entrance and exit access and forming a multiplicity of parking spaces, the facility comprising:

a) a multiplicity of stacking carriages longitudinally arranged one beside the other, each being displaceable longitudinally;

b) a multiplicity of pallets arranged on each stacking carriage in vertically stacked horizontal pairs, each pallet adapted for receiving a parked motor vehicle;

c) a lifting passage formed between any two selected stacking carriages by lateral displacement of at least one stacking carriage, and;

d) a pair of lifting carriages with a passage between the pair of lifting carriages wherein the pair of lifting carriages are positioned between the lifting passage between adjacent ones of the stacking carriages to cooperatively remove a selected individual pallet from an associated location on one of the stacking carriages adjacent said lifting passage wherein each of the lifting carriages respectively support opposite sides of the selected individual pallet and further wherein the pair of lifting carriages moves the selected pallet vertically through the lifting passage and replaces the pallet into one of the stacking carriages, each lifting carriage including a lifting fork with pivotable extension arms extendable into the passage between the pair of lifting carriages to support one of the opposite sides of the selected pallet;

wherein each said pair of lifting carriages can lift any selected pallet onto a level of the access.

2. The facility as claimed in claim 1, further comprising:

at least one conveying apparatus independent of said lifting carriages to laterally transport the pallets, the conveying apparatus being located either above or beneath the stacking carriages, said conveying apparatus selectively transporting a pallet from said lifting passage to the access and back.

3. The facility as claimed in claim 2, wherein the conveying apparatus comprises:

a rail system having a pair of elongated rail elements to movably support a pallet;

a chain conveyor having two parallel moveable chains parallel to and laterally offset from said rails;

at least one pallet push rod securable in a position perpendicularly across said parallel chains move therewith, the push rod being engageable with a pushing niche in a selected one of the pallets to convey the pallet along the rail elements in a direction of said chains.

4. The facility according to claim 1 wherein each pallet further comprises:

at least one lifting grate, each said lifting grate being located at said vehicle tire support region of said pallet, each lifting grate being moveable vertically and transversely horizontally to generally center an associated parked motor vehicle with respect to said pallet.

5. The facility according to claim 1 wherein each stacking carriage comprises:

a pair of central uprights, each of the uprights being mounted on an opposite side, and;

a plurality of extension arms extending from said uprights to receive and support the pallets.

6. The facility according to claim 1 further comprising:

rails on which the stacking carriages are movably supported.

7. The facility according to claim 1 further comprising:

a plurality of magnetic couplings, at least one of which being disposed between adjacent stacking carriages to selectively couple said adjacent stacking carriages together.

8. The facility according to claim 1 wherein the facility has two opposite end sides, each end side having at least one push and pull rod to displace the stacking carriages relative to said end sides for forming said lifting passage.

9. The facility according to claim 1 further comprising:

a plurality of rails, at least one said rail being provided for each lifting carriage, each lifting carriage traveling over the entire length of the facility on said associated rail.

10. The facility according to claim 1 further comprising:

a means for the intermediate storage of temporarily non-required pallets.

11. The facility as claimed in claim 10, wherein the means for the intermediate storage of temporarily non-required pallets comprises a stack-type store having a moveable lifting table disposed therein for storing a stack of pallets and for receiving and releasing an individual pallet on a top of said stack at said level of the access.

12. A parking facility comprising:

a plurality of stacking carriages arranged end-to-end in a longitudinally horizontal manner, the stacking carriages being longitudinally moveable to form a lifting passage between a selected two of the stacking carriages or at an end of the facility;

a plurality of pallets removably supportable in a stacked, vertically-spaced manner on each of said plurality of stacking carriages;

an access level along which pallets are delivered to said lifting passage; and a pair of lifting carriages with a passage between the pair of lifting carriages wherein the pair of lifting carriages are positioned between the lifting passage between adjacent ones of said stacking carriages, wherein each of the pair of lifting carriages cooperatively engaging and supporting respective opposite sides of a selected one of the pallets and cooperatively conveying that pallet between a position on one of the stacking carriages and the access level via said lifting passage wherein each lifting carriage includes a lifting mechanism having means for selectively engaging a respective side of one of the pallets wherein the lifting mechanism extends into the passage between the pair of lifting carriages.

13. The parking facility according to claim 12, wherein a width of said lifting passage in a direction between said stacking carriages is approximately a width of an automobile, and wherein said pallets are sized to movably fit pass through said passage.

14. The parking facility according to claim 12, wherein adjacent stacking carriages are selectively joinable by a magnetic coupling, and wherein at least one stacking carriage positioned at an end is moveable by a push and pull rod.

15. The parking facility according to claim 12, further comprising:

a storage of unused pallets; and a conveying apparatus for horizontally delivering a pallet along said access level between said storage and said lifting passage.

16. The parking facility according to claim 15, wherein said storage includes a stack of the unused pallets.

17. The parking facility according to claim 15, wherein the conveying apparatus comprises:

at least two parallel rails on which the pallets are rollably supportable;

at least two chains parallel to said rails on which the pallets are rollably supportable, said chains being horizontally spaced from each other and moveable in unison; and a rod securable transversely across said chains and engageable with a selected one of said pallets, holding the said pallet relative to said chains for movement therewith along said at least two rails.

18. The parking facility according to claim 12 wherein each of said lifting carriages comprises:

a base which is rollably supported on at least one rail; and a vertical support connected to said base wherein the lifting mechanism is vertically moveable along said vertical support.

19. The parking facility according to claim 18, wherein said means for selectively engaging includes a pair of arms which are cooperatively pivotable between a disengaged position free of the pallet to an engaged position under the pallet.

20. The parking facility according to claim 19, wherein said base is rollably supported on a single rail.

* * * * *